US010184727B2

(12) United States Patent
Schwalm

(10) Patent No.: US 10,184,727 B2
(45) Date of Patent: Jan. 22, 2019

(54) NESTED LOOP HEAT EXCHANGER

(71) Applicant: Hamilton Sundstrand Corporation, Charlotte, NC (US)

(72) Inventor: Gregory K. Schwalm, Avon, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 38 days.

(21) Appl. No.: 15/155,971

(22) Filed: May 16, 2016

(65) Prior Publication Data

US 2017/0328640 A1 Nov. 16, 2017

(51) Int. Cl.
*F28D 7/00* (2006.01)
*F28D 1/047* (2006.01)

(52) U.S. Cl.
CPC ..... *F28D 7/0016* (2013.01); *F28D 1/0476* (2013.01)

(58) Field of Classification Search
CPC ..... F28D 1/0475; F28D 1/0476; F28D 1/047; F28D 7/0016; F28F 13/08
USPC ..... 165/146, 147
See application file for complete search history.

(56) References Cited

U.S. PATENT DOCUMENTS 1,862,735 A * 6/1932 Beling ..... F28D 1/047 165/146
2,994,724 A * 8/1961 Segura ..... C07C 4/04 122/247
4,313,491 A * 2/1982 Molitor ..... F28D 7/024 165/160
4,570,452 A * 2/1986 Bingham ..... F24J 3/081 165/146
8,387,684 B2 * 3/2013 Capelle ..... F28D 7/06 165/160
9,696,094 B2 * 7/2017 Aoki ..... F28D 1/0476
2006/0067052 A1 * 3/2006 Llapitan ..... F28D 1/05375 361/700
2008/0223563 A1 9/2008 Penny et al.
2009/0090486 A1 * 4/2009 Geskes ..... F28D 7/06 165/51
2010/0243220 A1 * 9/2010 Geskes ..... F02B 29/0418 165/133
2011/0272128 A1 * 11/2011 Suzuki ..... F28D 1/0476 165/185
2013/0201628 A1 * 8/2013 Aoki ..... F28D 1/0476 361/699

(Continued)

FOREIGN PATENT DOCUMENTS

EP 0199321 A1 10/1986
JP 2000304472 A * 11/2000 ..... F28D 1/0476

(Continued)

OTHER PUBLICATIONS

Search Report dated Oct. 19, 2017 in U380739EP, EP Patent Application No. EP17171341, 6 pages.

*Primary Examiner* — David Teitelbaum
*Assistant Examiner* — For K Ling
(74) *Attorney, Agent, or Firm* — Cantor Colburn LLP

(57) ABSTRACT

A heat exchanger to exchange heat from a first fluid to a second fluid includes a center manifold to receive the first fluid, a first inner loop having an inner loop inlet and an inner loop outlet, and a first outer loop disposed around the first inner loop, the first outer loop having an outer loop inlet and an outer loop outlet, wherein the inner loop inlet and the outer loop inlet are adjacent, and the inner loop outlet and the outer loop outlet are adjacent.

8 Claims, 2 Drawing Sheets

(56) References Cited

U.S. PATENT DOCUMENTS

2013/0240177 A1 9/2013 Howard et al.

FOREIGN PATENT DOCUMENTS

| | | | | |
|---|---|---|---|---|
| JP | 2013145830 | A | * | 7/2013 |
| WO | 2008058734 | A1 | | 5/2008 |
| WO | 2012141599 | A1 | | 10/2012 |

* cited by examiner

NESTED LOOP HEAT EXCHANGER

BACKGROUND

The subject matter disclosed herein relates to heat exchangers, and more particularly, to heat exchangers for aircrafts.

Heat exchangers are utilized within an aircraft to cool high temperature high pressure air flow to maintain air flow within operational parameters. Heat exchangers can be subject to high levels of vibration. Often, heat exchangers may not provide desired levels of structural integrity and flow performance.

BRIEF SUMMARY

According to an embodiment, a heat exchanger to exchange heat from a first fluid to a second fluid includes a center manifold to receive the first fluid, a first inner loop having an inner loop inlet and an inner loop outlet, and a first outer loop disposed around the first inner loop, the first outer loop having an outer loop inlet and an outer loop outlet, wherein the inner loop inlet and the outer loop inlet are adjacent, and the inner loop outlet and the outer loop outlet are adjacent.

Technical function of the embodiments described above includes a first outer loop disposed around the first inner loop, the first outer loop having an outer loop inlet and an outer loop outlet, wherein the inner loop inlet and the outer loop inlet are adjacent, and the inner loop outlet and the outer loop outlet are adjacent Other aspects, features, and techniques of the embodiments will become more apparent from the following description taken in conjunction with the drawings.

BRIEF DESCRIPTION OF THE DRAWINGS

The subject matter is particularly pointed out and distinctly claimed in the claims at the conclusion of the specification. The foregoing and other features, and advantages of the embodiments are apparent from the following detailed description taken in conjunction with the accompanying drawings in which like elements are numbered alike in the FIGURES:

DETAILED DESCRIPTION

Figure 1:
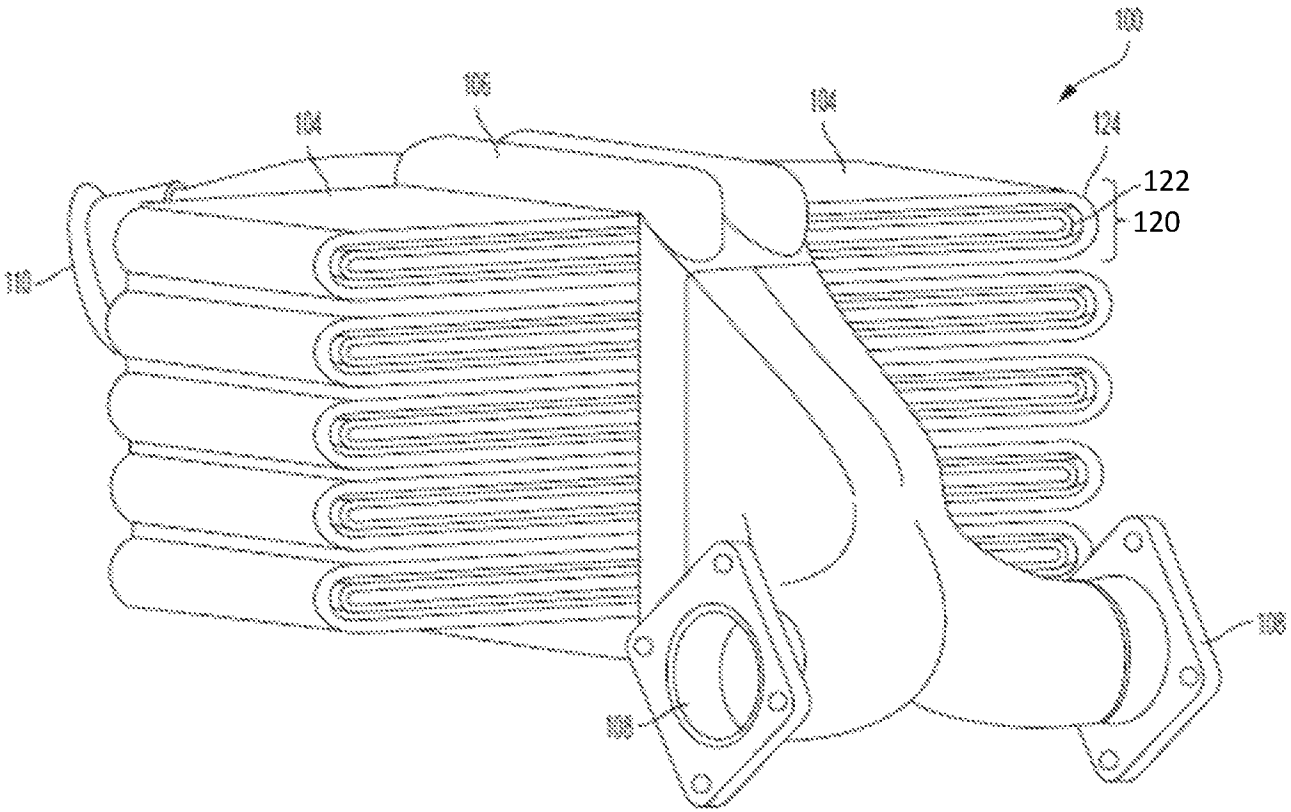
FIG. 1 is a perspective view of one embodiment of a heat exchanger.

Referring to the drawings, FIG. 1 shows a heat exchanger 100. In the illustrated embodiment, the heat exchanger 100 includes a center manifold 106 and cooling loops 104. The heat exchanger 100 can receive a hot air flow and exchange or otherwise transfer heat to cooler air that passes through the heat exchanger 100. The heat exchanger 100 can receive and cool high pressure, high temperature air from an aircraft engine bleed source or any other suitable source. In the illustrated embodiment, the heat exchanger 100 can be manufactured using additive manufacturing techniques. In certain embodiments, the heat exchanger 100 can be a plate-fin center manifold design. In the illustrated embodiment, the heat exchanger 100 behaves like a single-pass cross-flow heat exchanger. Advantageously, the heat exchanger 100 can increase operational efficiency by preventing the mixing of the hot inlet flow and the cooled outlet flow.

In the illustrated embodiment, the center manifold 106 can receive fluid flow and distribute a fluid flow to the aircraft. In certain embodiments, the center manifold 106 can receive hot air flow and distribute a cooled air flow to the aircraft. In the illustrated embodiment, the center manifold 106 includes an air inlet 108 and an air outlet 110. In certain embodiments, the air inlet 108 and the air outlet 110 can be referred to interchangeably depending on the air flow direction of the system utilized. In the illustrated embodiment, airflow is directed into the air inlets 108. The center manifold 106 directs flow from the air inlet 108 to the inlets of the cooling loops 104. As airflow passes through the cooling loops 104, the cooling loops 104 outlet airflow back to the center manifold 106. The center manifold 106 can direct air out of the heat exchanger 100 via the air outlet 110. A temperature gradient across the air inlet 108 and the air outlet 110 is formed by the cooling of the airflow. Advantageously, the use of a center manifold 106 allows for a compact heat exchanger 100.

In the illustrated embodiment, cooling loops 104 allow the hot airflow to exchange heat with a cooling cross flow. In the illustrated embodiment, the cooling loops 104 include nested loops 120 with inner loops 122 and outer loops 124. Advantageously, nested loops 120 minimize thermal conduction from hot inlet flow to the cooler outlet flow across adjacent inlets and outlets. In the illustrated embodiment, nested loops 120 can decrease the size and weight of the heat exchanger 100 as much as 40% compared to conventional cooling loops.

Figure 2:
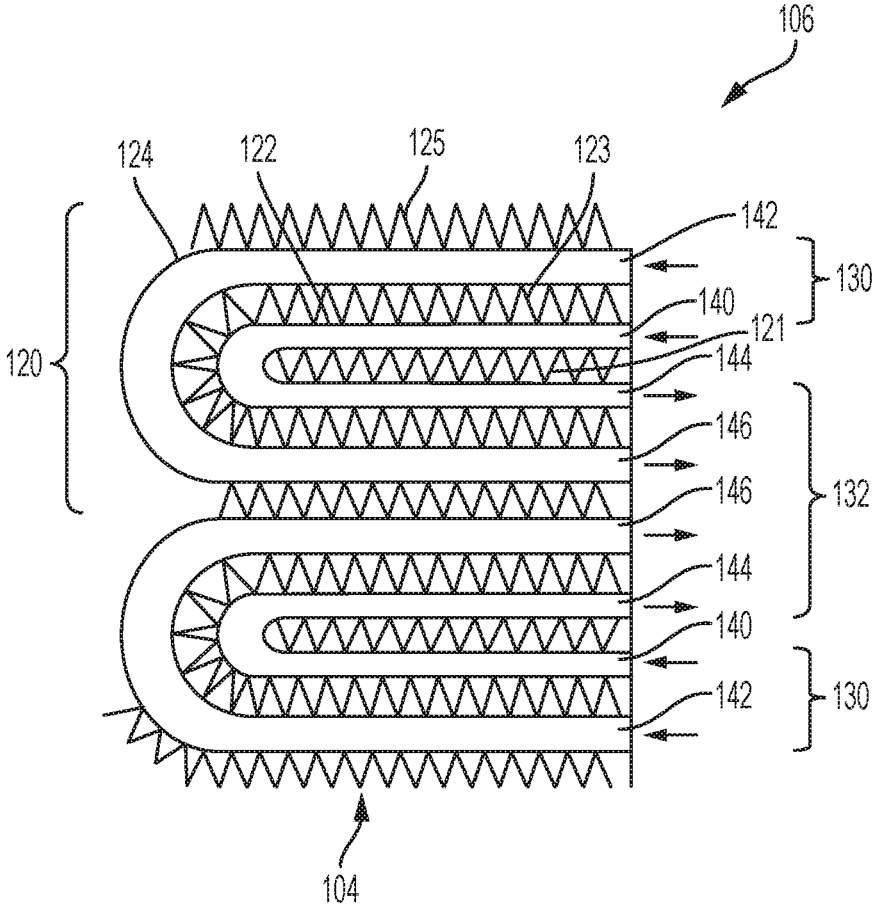
FIG. 2 is a schematic view of one embodiment of nested loops for use with the heat exchanger of FIG. 1.

Referring to FIG. 2, one embodiment of the nested loops 120 is shown. As previously described, each of the nested loops 120 includes outer loops 124 disposed around inner loops 122. In the illustrated embodiment, each of the outer loops 124 and the inner loops 122 can allow and direct airflow therethrough. In the illustrated embodiment, the outer loops 124 and the inner loops 122 are part of a plate-fin construction which are represented by the cooling fins 121, 123, and 125. The plate-fin construction receives heat from the inner loops 122 and the outer loops 124 to remove heat from the hot air flow. Advantageously, the illustrated embodiment of the nested loops 120 halves the number of adjacent hot inlet and hot outlets over the entire stack height of the heat exchanger 100, reducing the total amount of unwanted heat transfer.

In the illustrated embodiment, the inner loops 122 each include an inlet 140 and an outlet 144. The inner loops 122 are defined by the cooling fins 121 and 123 disposed around the inner loops 122. Airflow is received from the center manifold 106. Airflow is directed to the inlet region 130 and into the inlet 140. Airflow is directed through the inner loop 122. As the air flow passes through the inner loop 122, the plate-fin construction allows cross flow of cool air to pass through the cooling fins 121 and 123 to remove heat from the hot air flow through the inner loop 122. The inner loop 122 is exposed to the inner cooling fins 121 on both sides of the cooling fins 121, while the inner loop is exposed to one side of the cooling fins 123. As airflow continues through the inner loop 122, the airflow exits the outlet 144. In the illustrated embodiment, the outlets 144 are disposed in the outlet region 132 of the center manifold 106.

In the illustrated embodiment, the outer loops 124 each include an inlet 142 and an outlet 146. The outer loops 124 are defined by the cooling fins 123 and 125 disposed around the outer loops 124. Airflow is received from the center manifold 106. Airflow is directed to the inlet region 130 and into the inlet 142. Airflow is directed through the outer loop 124. As the air flow passes through the outer loop 124, the plate-fin construction allows cross flow of cool air to pass through the cooling fins 123 and 125 to remove heat from the hot air flow through the outer loop 124. The outer loop 124 is exposed to the inner cooling fins 123 on both sides of the cooling fins, while the outer loop 124 is exposed to one side of the cooling fins 125. As airflow continues through the outer loop 124, the airflow exits the outlet 146. In the illustrated embodiment, the outlets 146 are disposed in the outlet region 132 of the center manifold 106.

In certain embodiments, the flow length path of inner loop 122 and the outer loop 124 is roughly of equal flow length. Advantageously, uniform hot flow distribution allows the heat exchanger 100 to achieve peak thermal performance for a given amount of heat transfer surface area. In other embodiments, the flow length path of the inner loop 122 and the outer loop 124 are not of equal length.

In the illustrated embodiment, the inner loop 122 is disposed within the outer loop 124. As shown, this nested loop 120 arrangement allows for a common inlet region 130 wherein airflow is received by the adjacent inlets 140 and 142. Airflow from the air inlet 108 can be directed toward the common inlet region 130. Similarly, the nested loop 120 arrangement allows for a common outlet region 132 wherein cooled airflow from the outlets 144 and 146 are adjacent. Airflow from the outlets 144 and 146 can be directed to the air outlet 110. In certain embodiments, the outlet 146 of the outer loop 124 can be disposed adjacent to an outlet 144 of an inner loop 122 and another outlet 146 of another outer loop 124. Further, in certain embodiments, additional inner loops 122 can be disposed within an outer loop 124 to allow for additional inlets and outlets to be adjacent to each other without created undesired heat transfer between the inlets and outlets. Advantageously, the nested loop arrangement provides significant reduction in unwanted heat transfer between adjacent hot inlets and outlets, especially for designs in which the hot flow passages are long, because the difference between the shortest and the longest hot flow passage length decreases, with subsequent reduction in variation in hot flow rates among the hot loops.

In certain embodiments, the heat exchanger structures described herein can be manufactured by conventional techniques such as metal-forming techniques. The materials are not limited to metals and for some applications, polymer heat exchangers can also be utilized. In certain embodiments, additive manufacturing is used to fabricate any part of or all of the heat exchanger structures. Additive manufacturing techniques can be used to produce a wide variety of structures that are not readily producible by conventional manufacturing techniques.

In certain embodiments, the heat exchanger can be manufactured by advanced additive manufacturing ("AAM") techniques such as (but not limited to): selective laser sintering (SLS) or direct metal laser sintering (DMLS), in which a layer of metal or metal alloy powder is applied to the workpiece being fabricated and selectively sintered according to the digital model with heat energy from a directed laser beam. Another type of metal-forming process includes selective laser melting (SLM) or electron beam melting (EBM), in which heat energy provided by a directed laser or electron beam is used to selectively melt (instead of sinter) the metal powder so that it fuses as it cools and solidifies.

In certain embodiments, the heat exchanger can made of a polymer, and a polymer or plastic forming additive manufacturing process can be used. Such process can include stereolithography (SLA), in which fabrication occurs with the workpiece disposed in a liquid photopolymerizable composition, with a surface of the workpiece slightly below the surface. Light from a laser or other light beam is used to selectively photopolymerize a layer onto the workpiece, following which it is lowered further into the liquid composition by an amount corresponding to a layer thickness and the next layer is formed.

Polymer components can also be fabricated using selective heat sintering (SHS), which works analogously for thermoplastic powders to SLS for metal powders. Another additive manufacturing process that can be used for polymers or metals is fused deposition modeling (FDM), in which a metal or thermoplastic feed material (e.g., in the form of a wire or filament) is heated and selectively dispensed onto the workpiece through an extrusion nozzle.

The terminology used herein is for the purpose of describing particular embodiments only and is not intended to be limiting of the embodiments. While the description of the present embodiments has been presented for purposes of illustration and description, it is not intended to be exhaustive or limited to the embodiments in the form disclosed. Many modifications, variations, alterations, substitutions or equivalent arrangement not hereto described will be apparent to those of ordinary skill in the art without departing from the scope and spirit of the embodiments. Additionally, while various embodiments have been described, it is to be understood that aspects may include only some of the described embodiments. Accordingly, the embodiments are not to be seen as limited by the foregoing description, but are only limited by the scope of the appended claims.

What is claimed is:

1. A heat exchanger, comprising:

a center manifold;

first and second inner loops respectively comprising first and second inner loop inlets and first and second inner loop outlets; and first and second outer loops respectively disposed around the first and second inner loops, the first and second outer loops respectively comprising first and second outer loop inlets and first and second outer loop outlets, wherein:

the first inner and outer loop inlets are adjacent, the second inner and outer loop inlets are adjacent and the first and second outer loop inlets have larger flow areas than the first and second inner loop inlets the first inner and outer loop outlets are adjacent, the second inner and outer loop outlets are adjacent and the first and second outer loop outlets have larger flow areas than the first and second inner loop outlets, and wherein the first and second outer loop outlets are adjacent, the first inner loop outlet is between the first outer loop outlet and the first inner loop inlet, the second inner loop outlet is between the second outer loop outlet and the second inner loop inlet, the first inner loop inlet is between the first inner loop outlet and the first outer loop inlet, and the second inner loop inlet is between the second inner loop outlet and the second outer loop inlet.

2. The heat exchanger of claim 1, wherein the first and second outer loop inlets and outlets have substantially similar flow areas.

3. The heat exchanger of claim 1, wherein the first and second inner loop inlets and outlets have substantially similar flow areas.

4. The heat exchanger of claim 1, further comprising:

central fins disposed between the first and second outer loop outlets;

exterior fins disposed at respective exteriors of the first and second outer loops;

first intermediate and inner fins disposed between the first outer and inner loops and between the first inner loop inlet and the first inner loop outlet, respectively; and second intermediate and inner fins disposed between the second outer and inner loops and between the second inner loop inlet and the second inner loop outlet, respectively.

5. A heat exchanger, comprising:

a center manifold;

first and second inner loops respectively comprising narrow first and second inner loop inlets and narrow first and second inner loop outlets; and first and second outer loops respectively disposed around the first and second inner loops, the first and second outer loops respectively comprising wide first and second outer loop inlets and wide first and second outer loop outlets, wherein the narrow first inner and outer loop inlets are adjacent, the narrow second inner and outer loop inlets are adjacent, the wide first inner and outer loop outlets are adjacent, and the wide second inner and outer loop outlets are adjacent, and wherein the wide first and second outer loop outlets are adjacent, the narrow first inner loop outlet is between the wide first outer loop outlet and the narrow first inner loop inlet, the narrow second inner loop outlet is between the wide second outer loop outlet and the narrow second inner loop inlet, the narrow first inner loop inlet is between the narrow first inner loop outlet and the wide first outer loop inlet, and the narrow second inner loop inlet is between the narrow second inner loop outlet and the wide second outer loop inlet.

6. The heat exchanger of claim 5, wherein the wide first and second outer loop inlets and outlets have substantially similar flow areas.

7. The heat exchanger of claim 5, wherein the narrow first and second inner loop inlets and outlets have substantially similar flow areas.

8. The heat exchanger of claim 5, further comprising:

central fins disposed between the wide first and second outer loop outlets;

exterior fins disposed around respective exteriors of the first and second outer loops;

first intermediate and inner fins disposed between the first outer and inner loops and between the narrow first inner loop inlet and the narrow first inner loop outlet, respectively; and second intermediate and inner fins disposed between the second outer and inner loops and between the narrow second inner loop inlet and the narrow second inner loop outlet, respectively.

* * * * *